United States Patent [19]

Oloman et al.

[11] 3,969,201

[45] July 13, 1976

[54] ELECTROLYTIC PRODUCTION OF ALKALINE PEROXIDE SOLUTIONS

[75] Inventors: Colin William Oloman; Alan Paul Watkinson, both of Vancouver, Canada

[73] Assignee: Canadian Patents and Development Limited, Ottawa, Canada

[22] Filed: Jan. 13, 1975

[21] Appl. No.: 540,533

[52] U.S. Cl. ..... 204/83; 204/1 R; 204/84; 204/222

[51] Int. Cl.[2] ..... C25B 1/30

[58] Field of Search ..... 204/1 R, 222, 83, 84

[56] References Cited

UNITED STATES PATENTS

| | | | |
|---|---|---|---|
| 3,220,941 | 11/1965 | Osborne | 204/180 P |
| 3,607,687 | 9/1971 | Grangaard | 204/84 |
| 3,716,459 | 2/1973 | Salter et al. | 204/1 R |
| 3,793,173 | 2/1974 | Kawahata et al. | 204/84 |

*Primary Examiner*—T. Tung

*Attorney, Agent, or Firm*—Fisher, Christen & Sabol

[57] ABSTRACT

A novel electrolytic cell and process are described for producing alkaline peroxide solutions. The cell has an anode and cathode in spaced apart relationship, with the cathode being in the form of a fluid permeable conductive mass e.g. a packed bed of graphite particles, separated from the anode by a barrier wall. This barrier wall can be either a cation specific membrane dividing the cell into separate cathode and anode chambers or an insulating mesh permitting free flow of electrolyte between the cathode and anode. An aqueous alkaline electrolyte and oxygen are passed through the cathode bed and the peroxide is generated in the solution within the cathode bed. The alkaline peroxide obtained is directly usable in wood pulp bleaching operations.

16 Claims, 5 Drawing Figures

ELECTROLYTIC PRODUCTION OF ALKALINE PEROXIDE SOLUTIONS

BACKGROUND OF THE INVENTION

1. Field of the Invention

This invention relates to the preparation of alkaline peroxide solutions and electrolytic cells for the production thereof. In particular, it relates to the manufacture of peroxide bleach solutions having an alkaline concentration such that the solution is suitably directly usable in wood pulp bleaching operations.

2. Description of the Prior Art

Hydrogen peroxide is a strong chemical oxidizing agent whose greatest single use is in the bleaching of cotton and wood pulp.

The production of hydrogen peroxide by the electroreduction of oxygen has been known since the nineteenth century and the literature contains a vast amount of material on this subject. One of the methods used was that described in Berl, U.S. Pat. No. 2,000,815. Berl carried out the electro-reduction of oxygen on a specially prepared porous plate of active carbon. Oxygen was introduced from one side of the plate and catholyte from the other. The reaction took place on the surfaces of the plate facing the counter electrodes. Strong solutions of potassium hydroxide were used as the catholyte and a porous diaphragm was used to separate the anode and cathode chambers. With a catholyte containing of the order of 20% potassium hydroxide Berl produced 12 to 15% solutions of hydrogen peroxide at a superficial current density of from 0.2 to 0.35 amp./cm.$^2$. However, it was found that when sodium hydroxide was used as the catholyte the results were poor and the special electrode tended to disintegrate.

A more recent procedure of particular interest is that described in Grangaard, U.S. Pat. Nos. 3.454,477; 3,507,769; 3,459,652 and 3,592,749. Grangaard used as an electrode a porous carbon plate with the electrolyte and oxygen delivered from opposite sides for reaction on the plate. His porous gas diffusion electrode requires careful balancing of oxygen and electrolyte pressure to keep the reaction zone evenly on the surface of the porous plate. Moreover, as stated in U.S. Pat. No. 3,507,769, the Grangaard cell gives a peroxide concentration of only 0.5% with an $NaOH/H_2O_2$ ratio of 4/1. As described in U.S. Pat. No. 3,459,652, the Grangaard cathode consists of a specially prepared active carbon which is expensive to produce and also deteriorates with time.

Another feature of the Grangaard cell is that it contains an anode and a cathode chamber separated by a semi-previous diaphragm and requires the flow of electrolyte from the anode to the cathode chamber under a small hydrostatic head, to prevent the reaction of peroxide on the anode and a double pass electrolyte feed arrangement as described in U.S. Pat. No. 3,592,749. This has several disadvantages:

1. It complicates the construction of the cell;
2. It increases the electrical resistance of the cell by the resistance of the liquid in the anode chamber;
3. It complicates the operation of the cell, insofar as the flows of both oxygen gas and electrolyte must be continuously balanced for the proper condition to prevail in the cathode chamber. This becomes particularly difficult with flow arrangement as illustrated in U.S. Pat. No. 3,592,749;

4. The oxygen generated at the anode must be collected and pumped back to the cathode.

It is the object of the present invention to provide a simple and inexpensive system for producing alkaline peroxide solutions which will contain about the same amount of alkali as would ordinarily be added to a bleach liquor to adjust the pH of a wood pulp bleaching reaction.

SUMMARY OF THE INVENTION

According to the present invention a process and apparatus are provided for producing an alkaline peroxide-containing solution by the electrolysis of an alkaline electrolyte in an electrolytic cell. The process comprises passing an aqueous alkaline electrolyte and oxygen simultaneously, in a direction normal to the electric current flow through a fluid permeable conductive mass forming the cathode of the cell with this mass being separated from the anode by a barrier wall. In this manner the peroxide is generated in the solution within the cathode mass.

The electrolytic cell comprises in spaced apart relationship an anode and a cathode with the cathode comprising the above fluid permeable conductive mass, separated from the anode by the barrier wall. Inlets are provided for feeding aqueous alkaline electrolyte and oxygen into the cathode mass and outlet means are provided for removing alkaline peroxide containing solutions from the cathode mass. The cathode mass can conveniently have a thickness of about 0.1 to 2.0 centimeters in the direction of current flow.

The cathode mass can be in the form of a bed of particles or a fixed porous matrix. It must be composed of a conducting material which is a good electrocatalyst for the reduction of oxygen to peroxide in the reaction:

$$O_2+H_2O+2e^- \rightarrow OH^- + HO_2^- \quad (1)$$

but which is a poor catalyst for the subsequent reduction of peroxide to hydroxide in the reaction:

$$HO_2^- + H_2O + 2e^- \rightarrow 3OH^-$$

Graphite has been found to be particularly suitable for the cathode because it is cheap and required no special treatment. However, other forms of carbon may be used as well as certain metals, such as nickel and iron which have been treated to enhance their catalytic properties. In particulate form the particles typically have diameters in the range of about 0.005 to 0.5 cm. and can form either a fixed or fluidized bed. This bed of graphite particles is made to act as the cathode in an electrochemical reactor and oxygen, in association with alkali, reacts on the surfaces of the particles to give peroxide. In such a cathode the oxygen transfer limited current density is not exceeded and peroxide accumulates in the electrolyte.

The so-called "barrier wall" is preferably in the form of a porous insulating sheet which prevents the cathode particles from coming into actual contact with the anode but which permits free flow of electrolyte and the passage of oxygen between the cathode and anode. This can conveniently by a plastic fiber cloth or the like, for example polypropylene, which is compressed against the anode plate by the cathode bed. Of course a variety of materials can be used for making the insulating sheet provided they can withstand attack by the sodium hydroxide solutions and have high electrical resistance, e.g. asbestos, etc.

It was quite unexpectedly found in the cell with the porous insulating sheet that the peroxide formed on the cathode is not entirely destroyed on the anode and a reasonable current efficiency for peroxide production can be maintained even though the electrolyte is allowed to circulate freely between the cathode and the anode. This allows for great simplification in reactor design and a decrease in operating costs. Moreover, it has been found that with this system it is possible to obtain a product peroxide concentration of greater than 3% from a single pass of the electrolyte through the reactor.

According to an alternative arrangement, the barrier wall can be in the form of a cation specific membrane which forms separate cathode and anode chambers.

The cathode bed can be used as a two phase reactor with the oxygen already dissolved in the alkaline solution or it can be used as a three phase reactor into which oxygen gas and the catholyte solution are fed simultaneously. The oxygen gas in the reactor replenishes the oxygen dissolved in the catholyte, thus allowing higher current densities and increasing the concentration of peroxide in the reactor product. It has been found that the most advantageous arrangement is a three phase fixed bed reactor with co-current downward flow of catholyte and oxygen.

The alkaline electrolyte can typically be sodium hydroxide, potassium hydroxide, etc. However, because of cost and availability, sodium hydroxide is preferred, e.g. at a concentration in the range of about 0.01 to 6 molar.

The system is preferably operated at a superatomospheric oxygen pressure, e.g. in the range of about 0.2 to 30 atmospheres absolute, and this high pressure, together with the turbulent action of the gas and the electrolyte through the cathod bed permits the use of quite high superficial current densities, e.g. in the range of $10^{-3}$ to 1.0 Amp. $cm^{-2}$. The oxygen pressure can be obtained from substantially pure commercial oxygen (99.5% $O_2$) or from other oxygen containing gas, e.g. air. However, it is preferable to use substantially pure oxygen gas.

The operating temperature can conveniently be in the range of 0°– 80°C. Increased temperatures tend to lower the solubility of the oxygen in the catholyte, but increase the electrolyte conductivity.

There are a number of advantages in the system of the present invention over the systems described in the prior art as exemplified by the Grangaard patents. Thus, the cell of the present invention is much simpler in design as compared with the previous cells and it can produce a solution containing up to 3% of hydrogen peroxide with an $NaOH/H_2O_2$ ratio of 2/1. This ratio is critical to the commercial use of this solution in pulp bleaching and compared with a peroxide concentration from the Grangaard cell of only 0.5% with an $NaOH/H_2O_2$ ratio of 4/1. Moreover, the high pressures possible with the system of this invention permits much higher superficial current densities than are permissible with the Grangaard cell. The cathode material used in the present unit is cheaper and more readily available than those described in the prior art and with a single pass electrolyte flow, where it is not necessary to separate the catholyte from the anolyte, no problems of alkalinity build up in the anolyte or sodium ion build up in the catholyte occur. This is a prevailing problem in the prior art systems and, for instance, in U.S. Pat. No. 3,592,749 Grangaard required a complicated double-pass electrolyte flow arrangement to overcome the problem.

DESCRIPTION OF PREFERRED EMBODIMENTS

Certain specific embodiments of this invention will now be illustrated by reference to the following detailed description and accompanying drawings wherein.

Figure 1:
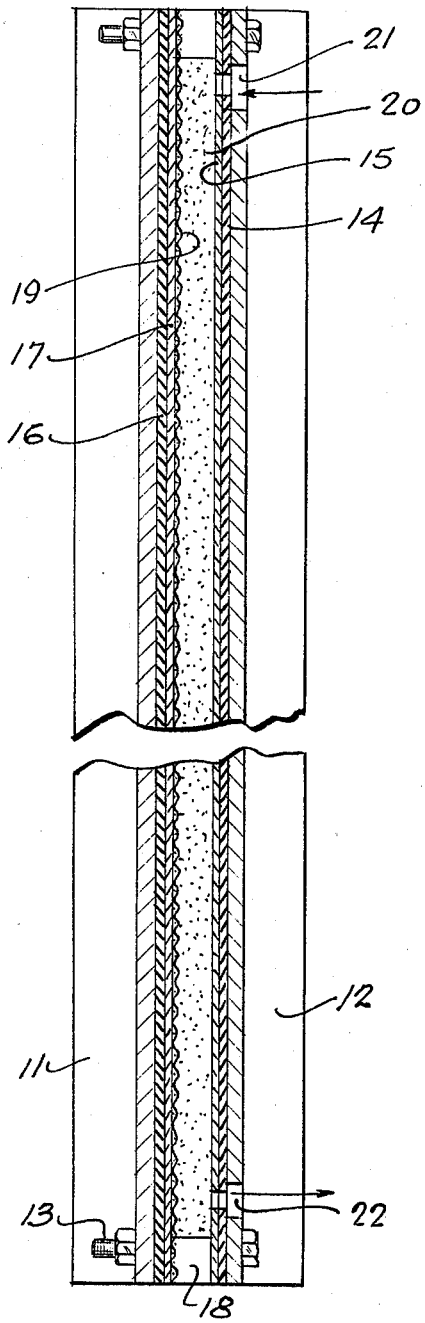
FIG. 1 is a cross-sectional view of a preferred arrangement of a cell for the electrochemical reduction of oxygen in accordance with the invention.
Figure 2:
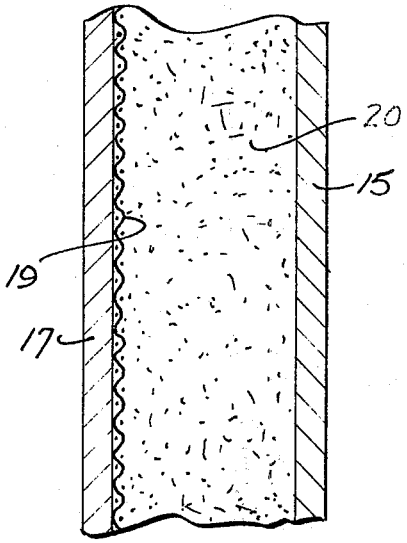
FIG. 2 is an enlarged detail of the cathode and anode of the cell in FIG. 1.

Looking now at FIGS. 1 and 2 of the drawings, a rectangular cell casing is made from two outer mild steel channel members 11 and 12 held together back to back by means of bolts 13. Adjacent channel member 12 is a neoprene insulator layer 14 and adjacent the insulator layer is a stainless steel cathode feeder plate 15. Likewise adjacent channel member 11 there is positioned a neoprene insulating layer 16 followed by a stainless steel anode plate 17. These stainless steel plates are held in spaced apart relationship by means of neoprene gaskets 18. Adjacent anode plate 17 there is positioned a plastic fiber fabric 19 and the space between this plastic fiber fabric 19 and the cathode feeder plate 15 is filled with small graphite particles 20.

At the top end of the cell is positioned an inlet port 21 for electrolyte and oxygen and at the bottom of the cell is positioned an outlet port 22 for the product obtained and the oxygen.

Figure 3:
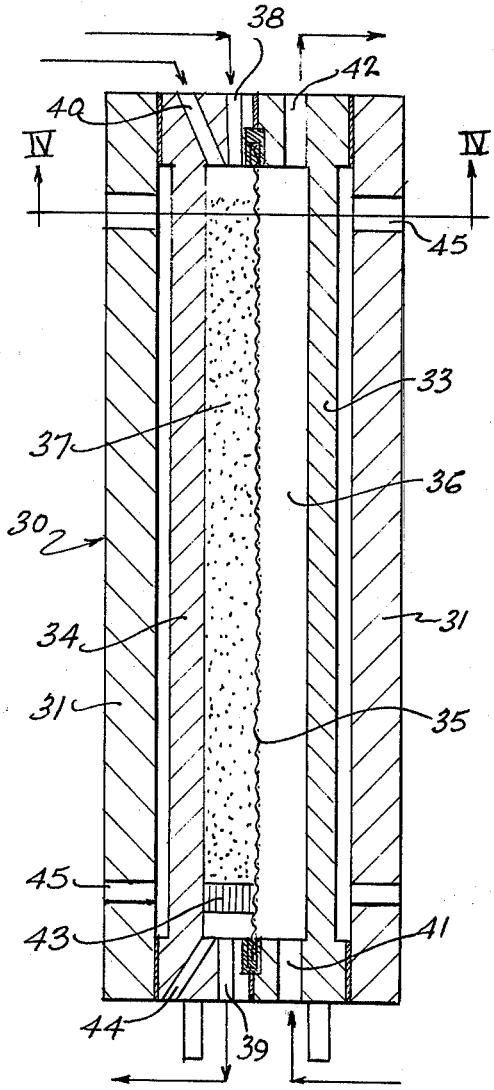
FIG. 3 illustrates an alternative embodiment of this cell in which the anode and cathode compartments are separated by a cation specific membrane.
Figure 4:
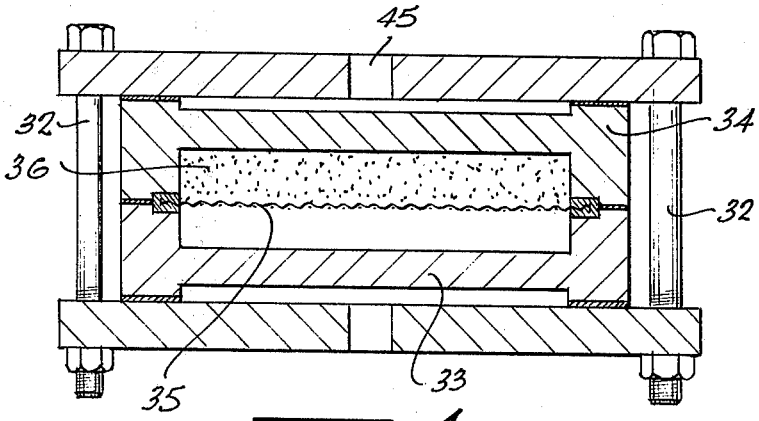
FIG. 4 is a cross-sectional view of the cell of FIG. 3, along line 4—4.

FIGS. 3 and 4 show an alternate design using a cation specific membrane. In this illustration numeral 30 generally designates a cell unit having a casing of rectangular section and of electrically non-conducting material having sidewalls 31 compressibly held together by means of bolts 32. An anode 33, conveniently made of stainless steel, is mounted within the casing in spaced apart relationship with a cathode feeder plate 34, preferably also made of stainless steel. Between these two stainless steel plates is interposed a diaphragm 35 in the form of a cation specific membrane backed by a perforated backing plate. The space between anode 33 and membrane 35 forms an anode chamber 36 while the space between the membrane 35 and cathode feeder plate 34 forms a cathode chamber 37 which is filled with small graphite particles. These particles are supported at the bottom by a perforate distribution plate 43.

Enlarged portions at the ends of plates 33 and 34 form the top and bottom ends of the cell and the top end of the cathode plate includes a port 38 for feeding in dilute catholyte solution while the bottom end has an outlet port 39 for discharging reaction product. For a three phase operation a separate oxygen inlets port 40 is provided at the top end and an auxiliary oxygen feed port 44 may also be included at the lower end.

On the anode side an anolyte inlet port 41 is provided at the bottom end and an anolyte product outlet port 42 is provided at the top end.

Cooling water may be necessary for the cell and this can be passed through spaces behind anode plate 33 and cathode feeder plate 34 via ports 45.

Figure 5:
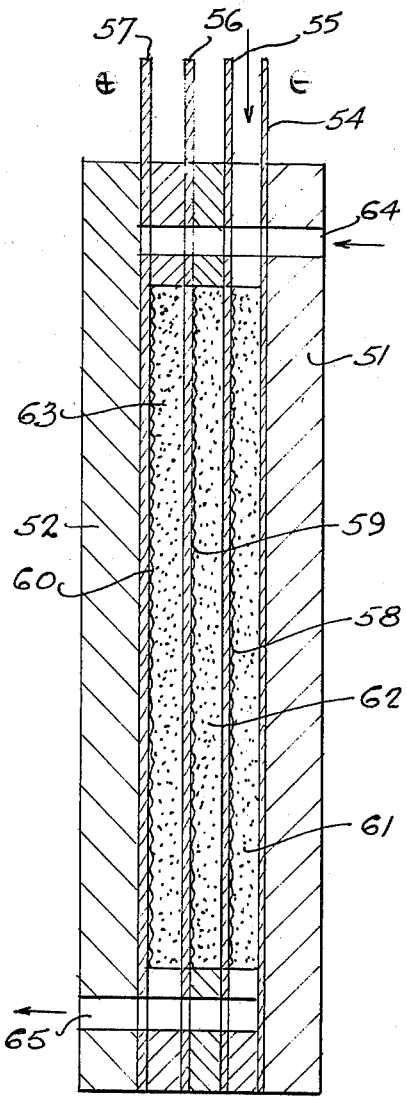
FIG. 5 is a schematic cross-sectional view of a unit with three parallel cells using bi-polar electrodes.

FIG. 5 describes a cell unit with multiple cells, using bi-polar electrodes. The multiple cells are retained between compression plates 51 and 52 with the unit being sealed by means of neoprene gaskets. Positioned adjacent the compression plates 51 and 52 are stainless steel cathode plate 54 and stainless steel anode plate 57 respectively. Spaced between these cathode and anode plates are stainless steel bi-polar electrode plates 55 and 56. The four stainless steel plates form therebetween three cathode compartments 61, 62 and 63. These compartments are filled with graphite particles and between the graphite particle beds and the adjacent stainless steel plates 55, 56 and 57 are polypropylene fabric membranes 58, 59 and 60 respectively.

A common inlet header 64 is provided for all three cells as well as a common outlet 65. Thus, there is parallel liquid flow from top to bottom through all three cells. On the other hand, the plates 54, 55, 56, and 57 are electrically connected in series with respect to current flow.

The following examples are given to illustrate the invention but are not deemed to be limiting thereof.

EXAMPLE 1

A cell was prepared according to FIGS. 1 and 2. The cathode bed was arranged as a fixed bed using graphite particles in the size range -0.42 + 0.30 mm. with a bed height of 200 cm. (6 feet 6 inches), a bed width of 2.5 cm. (1 inch) and a bed thickness (in the direction of flow of current) of 3 mm. (⅛ inch). This gave a superficial cathode area of 0.54 ft. $^2$.

The insulating fabric or mesh was a polypropylene fabric (Chicopee Fabric No. 6020430).

This cell was operated with co-current downward flow of oxygen and electrolyte under the following conditions:

| | |
|---|---|
| Electrolyte | 6% (1.6M) commercial grade NaOH (Hooker) in tap water |
| Oxygen | 99.5% commercial grade |
| Electrolyte flow | 2.6 $cm^3$ $min^{-1}$ |
| Oxygen flow | 1300 $cm^3$ $min^{-1}$ at S.T.P. |
| Reactor inlet pressure | 105 p.s.i.g. |
| Pressure drop through reactor | 60 p.s.i. |
| Current | 15 A (28 A. $ft^{-2}$) |
| Electrolyte feed temperature | 23°C |

The results obtained were as follows:

| | |
|---|---|
| Product $H_2O_2$ concentration | 3.0 wt% |
| Current efficiency | 50% |
| Power consumption (at cell) | 2.7 kwhr/lb $H_2O_2$ |
| $NaOH/H_2O_2$ ratio in product | 2 lb/lb |
| Oxygen consumed at cathode | 1.5 lb/lb $H_2O_2$ |
| Oxygen generated at anode | 1.0 lb/lb $H_2O_2$ |
| Net oxygen consumed | 0.5 lb/lb $H_2O_2$ |
| Oxygen feed | 20.6 lb/lb $H_2O_2$ |

EXAMPLE 2

The same cell was used as in Example 1 except that the insulating fabric used was canvas.

The cell was again operated with co-current downward flow of oxygen and electrolyte under the following conditions:

| | A | B |
|---|---|---|
| Electrolyte (wt. % NaOH) | 6.2 | 6.2 |
| Oxygen (% $O_2$) | 99.5 | 99.5 |
| Electrolyte Flow ($cm^3min^{-1}$) | 10.0 | 5.0 |
| Oxygen Flow ($cm^3min^{-1}$) | 700 | 1600 |
| Reactor Inlet Pressure (atm.abs.) | 4 | 6.5 |
| Current (A) | 20 | 24 |
| (A.$ft^{-2}$) | 38 | 44 |
| Voltage | 1.85 | 1.96 |

The results obtained were as follows:

| | A | B |
|---|---|---|
| Product $H_2O_2$ conc (wt.%) | 1.5 | 3.1 |
| Current Efficiency (%) | 78 | 68 |
| $NaOH/H_2O_2$ ratio in prod. (lb/lb) | 4.15 | 2.0 |
| Power Consumption (kwhr/lb $H_2O_2$) | 1.7 | 2.0 |

EXAMPLE 3

The same cell was used as in Example 1 except that the insulating fabric used was made from glass fiber cloth.

The cell was again operated with co-current downward flow of oxygen and electroylte under the following conditions:

| Experiment No. | I | II | III | IV | V |
|---|---|---|---|---|---|
| Electrolyte (wt% NaOH) | 6.0 | 10.0 | 6.0 | 6.0 | 12.0 |
| Oxygen (% $O_2$) | 99.5 | 99.5 | 99.5 | 99.5 | 99.5 |
| Electrolyte Flow ($cm^3min^{-1}$) | 3.0 | 3.3 | 4.6 | 2.6 | 2.0 |
| Oxygen Flow ($cm^3min^{-1}$) | 800 | 1,000 | 1,600 | 1,600 | 2,000 |
| Reactor Inlet Pressure (atm. abs) | 6.5 | 6.5 | 8.5 | 8.1 | 9.2 |
| Current (A) | 20 | 20 | 20 | 15 | 15 |
| (A.$ft^{-2}$) | 38 | 38 | 38 | 28 | 28 |
| Voltage | 1.82 | 1.73 | 2.26 | 1.90 | 1.74 |

The results obtained were as follows:

| | | | | | |
|---|---|---|---|---|---|
| Product $H_2O_2$ conc. (wt%) | 3.2 | 3.6 | 2.6 | 3.0 | 3.7 |
| Current Efficiency (%) | 50 | 60 | 62 | 53 | 54 |
| $NaOH/H_2O_2$ ratio in prod (lb/lb) | 1.9 | 2.8 | 2.3 | 2.0 | 3.2 |
| Power Consumption (kwhr/lb) $H_2O_2$) | 2.5 | 2.0 | 2.6 | 2.5 | 2.3 |

EXAMPLE 4

The same cell was used as in Example 3 with the same operation conditions as Experiment IV. The only difference was the use of air in place of a commercial grade of oxygen.

The results were as follows:

| | |
|---|---|
| Product $H_2O_2$ conc (wt%) | 0.92 |
| Current Efficiency (%) | 16 |
| $NaOH/H_2O_2$ ratio in prod. (lb/lb) | 6.5 |
| Power Consumption (kwhr/lb $H_2O_2$) | 8.4 |

EXAMPLE 5

A cell was prepared according to FIG. 3. The cathode bed was arranged as a fixed bed using graphite particles in the size range of 0.042 to 0.059 centimeters, with a bed height of 42 cm., a bed width of 5cm and a bed thickness (in the direction of current flow) of 1 cm. The anode chamber also measured 42cm × 5cm × 1cm and the cation membrane was Type C 100 manufactured by American Machine and Foundry Corp. This membrane was supported by 100 mesh nylon backed by a perforated plexiglass sheet.

Utilizing the above device, a 0.1 molar solution of sodium hydroxide was saturated with oxygen under 12 atmospheres pressure and passed into the top of cell 30 through port 38 at a flow of 0.05 liter per minute. At the same time a 0.1 molar solution of sodium hydroxide was passed upwardly through port 41 and through anode chamber 36 at a flow of 0.35 liter per minute. The cathode chamber 37 holds about 160 grams of graphite particles. The whole cell was held under a pressure of 12 atmospheres and a current of 3.5 amperes was passed with the graphite as the cathode. The cell was cooled with tap water so that the product solution was maintained at 18°C. The solution leaving the cathode through port 39 contained 0.014 gm. mol. per liter of hydrogen peroxide (i.e., 0.048 weight percent) which corresponds to a yield from oxygen of about 85% and a current efficiency for peroxide of 64%.

EXAMPLE 6

Again using the cell of Example 5 a 0.1 molar solution of sodium hydroxide was saturated with oxygen at 8 atmospheres pressure and passed at 0.01 liter per minute into the top of cell 30 through port 38. Simultaneously, 1.5 liter per minute (at S.T.P.) of oxygen gas was fed in through port 40. The anolyte being fed in through port 41 was a 0.2 molar solution of sodium hydroxide which flowed at 0.35 liter per minute. The whole reactor was held under 8 atmospheres pressure and a current of 24 amperes was passed with the exit temperature being held at 20°C. The graphite particle content was the same as in Example 5.

The solution leaving the cell through port 39 contained 0.15 gm. mol. per liter of hydrogen peroxide (0.5 weight percent) which corresponds to a current efficiency of 21%.

EXAMPLE 7

Once again using the cell of Example 5, a 0.1 molar solution of sodium hydroxide was saturated with air at atmospheric pressure and passed into the bottom of cell 30 through port 39 at 0.1 liters per minute. Oxygen gas was simultaneously introduced via port 44 at a flow of 1.2 liter per minute at S.T.P. The cathode compartment contained 140 grams of graphite particles in the size range of 0.042 to 0.059 cm. In this manner the bed was fluidized by the flow of liquid and gas so that the expansion was about 10%.

The anolyte being fed in through port 41 was a 1.0 molar solution of sodium hydroxide flowing at 0.1 liter per minute, the temperature was maintained at 18°C and the pressure in the reactor was 1 atmosphere.

In this case, a current of 1 ampere produced a catholyte solution containing 0.0022 gm. mol. per liter of hydrogen peroxide with a current efficiency of 70%.

EXAMPLE 8

In a cell similar to that of Example 5 but containing, in place of graphite, a cathode bed of nickel spheres in the size range −0.35 + 0.30 mm., an 0.1 M solution of sodium hydroxide, containing 0.01 M potassium cyanide and saturated with oxygen at 1.1 atmospheres absolute pressure, was passed downward through the cathode bed at 0.21 liter per minute. At the same time an 0.1 M solution of sodium hydroxide was passed up through the anode chamber at 0.1 liter per minute. A current of 1.05 amperes was used and the solution left the cathode bed at 18°C containing $1.2 \times 10^{-3}$ molar hydrogen peroxide, which corresponds to a yield of peroxide from oxygen of 84% and a current efficiency of 78%.

EXAMPLE 9

A cell was prepared according to FIG. 5 having 3 cells with a common header for gas and liquid flow, separated by single stainless steel plates which act as bi-polar electrodes. The cathode beds were fixed beds containing graphite particles in the size range −0.42 + 0.30 mm. with a bed height of 37 cm., a bed width of 4.8 cm. and a bed thickness (in direction of current flow) of 3 mm.

The insulating fabric was a polypropylene fabric (Chicopee Fabric No. 6020430).

The cell was operated with co-current downward flow of oxygen and electrolyte under the following conditions:

| | |
|---|---|
| Electrolyte | 6 wt % commercial grade NaOH in tap water |
| Oxygen | 99.5% commercial grade |
| Total electrolyte flow | 19 $cm^3$ $min^{-1}$ |
| Total oxygen flow | about 3000 $cm^3$ $min^{-1}$ at STP |
| Reactor inlet pressure | 35 psig |
| Pressure drop through reactor | 35 psig |
| Current | 15A |
| Voltage (across 3 cells) | 7.6 |
| Electrolyte feed temp. | 23°C |

The results obtained were as follows:

| | |
|---|---|
| Product $H_2O_2$ conc. | 1.07 wt % |
| Current Efficiency | 46% |
| Power Consumption | 3.8 kwhr/lb $H_2O_2$ |
| $NaOH/H_2O_2$ ratio in product | 5.6 |
| Net oxygen consumed | 0.5 lb/lb $H_2O_2$ |

THE embodiments of the invention in which an exclusive property or privilege is claimed are defined as follows:

1. A process for producing an alkaline peroxidecontaining solution by the electrolysis of an alkaline electrolyte in an electrolytic cell, which comprises passing an aqueous alkaline electrolyte and oxygen simultaneously in a direction normal to the electric current, through a fluid permeable conductive mass forming a cathode bed in said cell, said bed being separated from the anode by a barrier wall, whereby alkaline peroxide is generated in the solution within the cathode bed by reaction between the aqueous alkaline electrolyte and oxygen on the surfaces of the fluid permeable conductive mass forming the cathode bed.

2. A process according to claim 1 wherein said barrier wall is in the form of an alkaline resistant, porous insulating sheet which prevents the cathode mass from coming into actual contact with the anode but which permits free flow of electrolyte and the passage of oxygen between the cathode and anode.

3. A process according to claim 2 wherein the cathode mass is in the form of a bed of conductive particles.

4. A process according to claim 3 wherein the conductive particles are graphite particles.

5. A process according to claim 4 wherein the alkaline electrolyte is a solution of sodium hydroxide.

6. A process according to claim 5, wherein the sodium hydroxide solution has a concentration in the range of about 0.01 to 6.0 molar.

7. A process according to claim 5 wherein the graphite particles have diameters in the range of 0.005 to 0.5 cm.

8. A process according to claim 7 wherein the cathode bed has a thickness of about 0.1 to 2.0 cm. in the direction of current flow.

9. A process according to claim 7 wherein the cathode bed is in the form of a fixed bed.

10. A process according to claim 7 wherein the cathode bed is in the form of a fluidized bed.

11. A process according to claim 5 wherein the oxygen gas is dissolved in the sodium hydroxide solution before being fed to the cell.

12. A process according to claim 5 wherein the oxygen and sodium hydroxide solution are separately, co-currently fed to the cell.

13. A process according to claim 12 wherein the oxygen is fed at a pressure in the range of about 0.2 to 30 atmospheres.

14. A process according to claim 12 wherein the oxygen and sodium hydroxide solution are fed in a co-current, downward flow.

15. A process according to claim 2 wherein the superficial current density on the cathode is in the range of $10^{-3}$ to 1.0 amperes per square centimeter.

16. A process according to claim 1 wherein the barrier wall is a cation specific membrane forming separate cathode and anode chambers.

* * * * *